US008960131B2

(12) United States Patent
Gatley, Jr.

(10) Patent No.: US 8,960,131 B2
(45) Date of Patent: Feb. 24, 2015

(54) WATER HEATER HAVING UPSTREAM AND DOWNSTREAM MANIFOLDS

(71) Applicant: Regal Beloit America, Inc., Beloit, WI (US)

(72) Inventor: William S. Gatley, Jr., Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 185 days.

(21) Appl. No.: 13/801,325

(22) Filed: Mar. 13, 2013

(65) Prior Publication Data

US 2014/0261239 A1 Sep. 18, 2014

(51) Int. Cl.

| | |
|---|---|
| ***F24H 1/52*** | (2006.01) |
| ***F23L 1/00*** | (2006.01) |
| ***F24H 1/20*** | (2006.01) |
| ***F24H 9/00*** | (2006.01) |

(52) U.S. Cl.

CPC . *F23L 1/00* (2013.01); *F24H 1/205* (2013.01); *F24H 9/0026* (2013.01)

USPC ..... 122/19.1; 122/18.3

(58) Field of Classification Search

CPC ..... F22B 7/18

USPC ..... 122/13.01, 18.3, 19.1, 19.2, 155.3, 157, 122/164, 187

See application file for complete search history.

(56) References Cited

U.S. PATENT DOCUMENTS

| | | | | |
|---|---|---|---|---|
| 4,768,444 | A | 9/1988 | DeWerth et al. | |
| 4,790,289 | A * | 12/1988 | Barrett | 122/17.1 |
| 5,197,415 | A * | 3/1993 | Stretch et al. | 122/14.22 |
| 5,697,330 | A | 12/1997 | Yetman et al. | |
| RE37,389 | E | 9/2001 | Rutz et al. | |
| 6,398,512 | B2 | 6/2002 | Stewart | |
| 6,530,346 | B1 | 3/2003 | Coones et al. | |
| 6,602,058 | B1 | 8/2003 | Stewart | |
| 6,622,660 | B1 | 9/2003 | Bajic et al. | |
| 6,622,661 | B1 * | 9/2003 | Hotton | 122/13.01 |
| 7,159,540 | B2 | 1/2007 | Garrabrant et al. | |
| 7,250,870 | B1 | 7/2007 | Viner et al. | |
| 7,559,293 | B2 * | 7/2009 | Gordon et al. | 122/13.01 |
| 8,286,594 | B2 | 10/2012 | Smelcer | |
| 2007/0079771 | A1 | 4/2007 | Garrabrant et al. | |
| 2007/0084420 | A1 * | 4/2007 | Boros et al. | 122/18.1 |
| 2007/0215067 | A1 | 9/2007 | Garrabrant | |
| 2008/0216772 | A1 * | 9/2008 | Gordon et al. | 122/18.3 |
| 2009/0084328 | A1 | 4/2009 | Lyons et al. | |

* cited by examiner

*Primary Examiner* — Gregory A Wilson

(74) *Attorney, Agent, or Firm* — Thompson Coburn LLP

(57) ABSTRACT

A water heater system comprises a water tank, a burner plenum, a flue, a blower, a combustion air passageway, a dilution air passageway, an upstream manifold, and a downstream manifold. The upstream manifold divides air from the blower so that some air flows through the combustion air passageway to the burner plenum and some air flows through the dilution air passageway to the downstream manifold. The downstream manifold combines the air from the dilution air passageway with combustion products from the flue.

20 Claims, 2 Drawing Sheets

WATER HEATER HAVING UPSTREAM AND DOWNSTREAM MANIFOLDS

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

This invention relates generally to water heaters and, more particularly, to water heaters that use dilution air to cool hot gasses from the flue.

SUMMARY OF THE INVENTION

One aspect of the invention is a water heater system comprising a water tank, a jacket surrounding the water tank, a burner plenum, a flue, a blower, an upstream manifold, a combustion air passageway, a downstream manifold, and a dilution air passageway. The burner plenum is adjacent the water tank. A fuel burner is within the burner plenum and is configured and adapted to combust fuel to produce combustion products. The flue has an upstream end and a downstream end. The flue is at least partially within the water tank. The upstream end of the flue is in fluid communication with the burner plenum. The flue is configured for passage of combustion products from the burner plenum through the water tank and toward the downstream end of the flue. The blower is adapted and configured to blow air. The upstream manifold has an air intake passage, a combustion air discharge passage, and a dilution air discharge passage. The air intake passage is in fluid communication with and downstream of the blower. The upstream manifold is adapted and configured such that some air entering the intake passage via the blower is discharged out the combustion air discharge passage and some air entering the intake passage via the blower is discharged out the dilution air discharge passage. The combustion air passageway has an upstream end and a downstream end. The upstream end of the combustion air passageway is in fluid communication with the combustion air discharge passage of the upstream manifold. The combustion air passageway is adapted and configured to direct air discharged from the combustion air discharge passage of the air manifold to the burner. The downstream manifold has a combustion products intake passage, a dilution air intake passage and an exit passage. The combustion products intake passage is in fluid communication with the downstream end of the flue such that combustion products discharged from the flue enters the downstream manifold via the combustion products intake passage. The dilution air passageway is in fluid communication with the dilution air discharge passage of the upstream manifold and in fluid communication with the dilution air intake passage of the downstream manifold, the dilution air passageway is adapted and configured such that dilution air exiting the dilution air discharge passage of the upstream manifold flows through the dilution air passageway and into the downstream manifold via the dilution air intake passage.

The water heater system is adapted and configured such that air entering the downstream manifold via the dilution air intake passage and combustion products entering the downstream manifold via the combustion products intake passage are discharged together via the exit passage of the downstream manifold.

Another aspect of the present invention is a water heater system comprising a water tank, a jacket surrounding the water tank, a burner plenum adjacent the water tank, a pre-mix fuel burner within the burner plenum, a fuel supply line, a flue, a blower adapted and configured to blow air, a combustion air passageway, a dilution air passageway, an upstream manifold, and a downstream manifold. The pre-mix fuel burner is configured and adapted to combust fuel to produce combustion products. The flue has an upstream end and a downstream end. The upstream end of the flue is in fluid communication with the burner plenum. The flue is configured for passage of combustion products from the burner plenum through the water tank and toward the downstream end of the flue. The upstream manifold has an air intake passage, a combustion air discharge passage, and a dilution air discharge passage. The downstream manifold has a combustion products intake passage, a dilution air intake passage and an exit passage. The air intake passage of the upstream manifold is in fluid communication with and downstream of the blower. The upstream manifold is adapted and configured such that some air entering the intake passage via the blower is discharged out the combustion air discharge passage and some air entering the intake passage via the blower is discharged out the dilution air discharge passage. The fuel supply line is adapted to supply fuel into the combustion air passageway. The combustion air passageway facilitates fluid communication between the combustion air discharge passage of the upstream manifold and the fuel burner such that air from the blower via the combustion air discharge passage and fuel from the fuel supply line are fed to the pre-mix fuel burner via the combustion air passageway during operation of the water heater system. The combustion products intake passage of the downstream manifold is in fluid communication with the downstream end of the flue such that combustion products discharged from the flue during operation of the water heater system enters the downstream manifold via the combustion products intake passage. The dilution air passageway facilitates fluid communication between the dilution air discharge passage of the upstream manifold and the dilution air intake passage of the downstream manifold. The water heater system is adapted and configured such that air entering the downstream manifold via the dilution air intake passage and combustion products entering the downstream manifold via the combustion products intake passage are discharged together via the exit passage of the downstream manifold.

Further features and advantages of the present invention, as well as the structure and operation of various embodiments of the present invention, are described in detail below with reference to the accompanying drawings.

Figure 1:
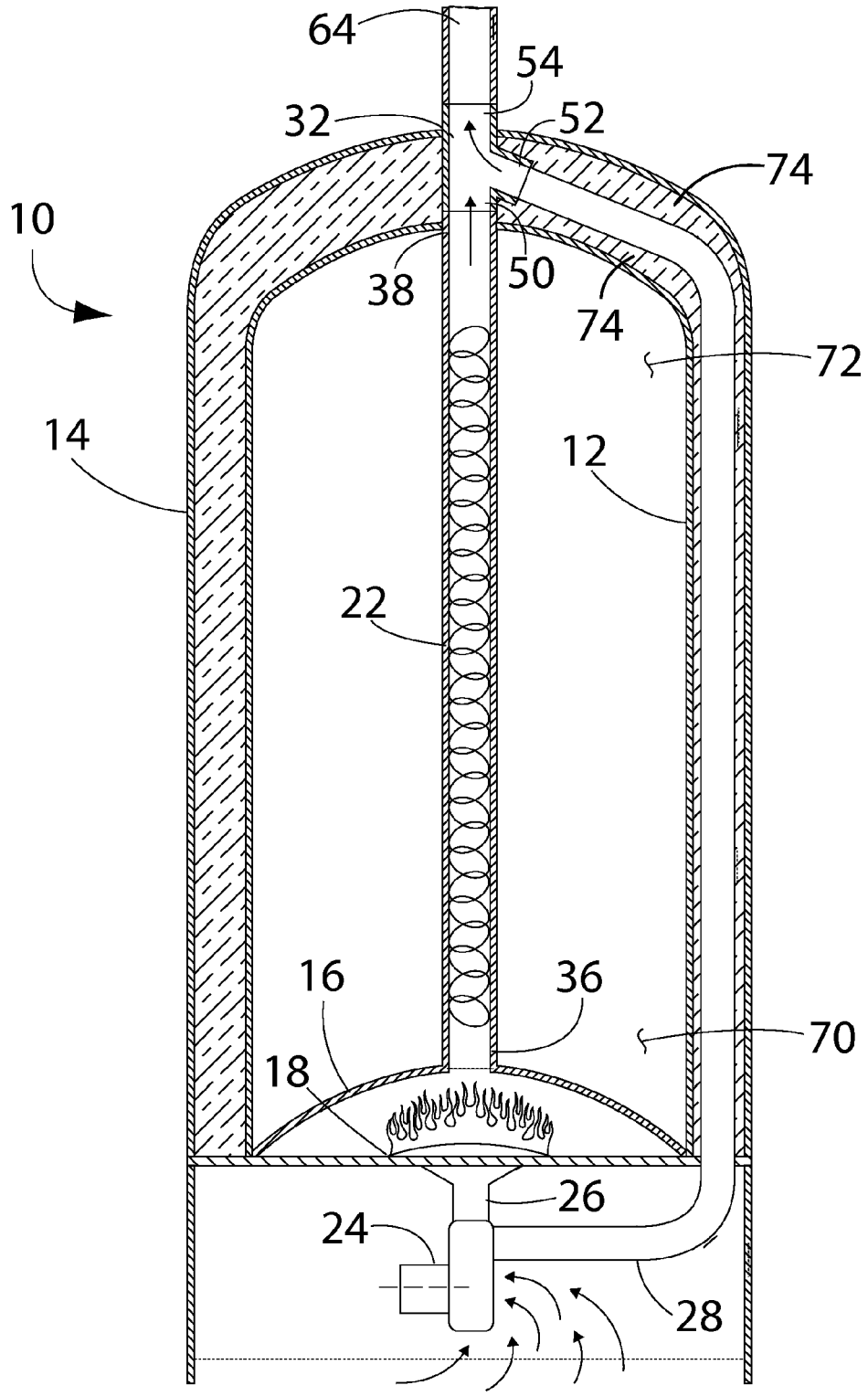
FIG. 1 is a schematic front sectional view of an embodiment of a water heater system of the present invention.
Figure 2:
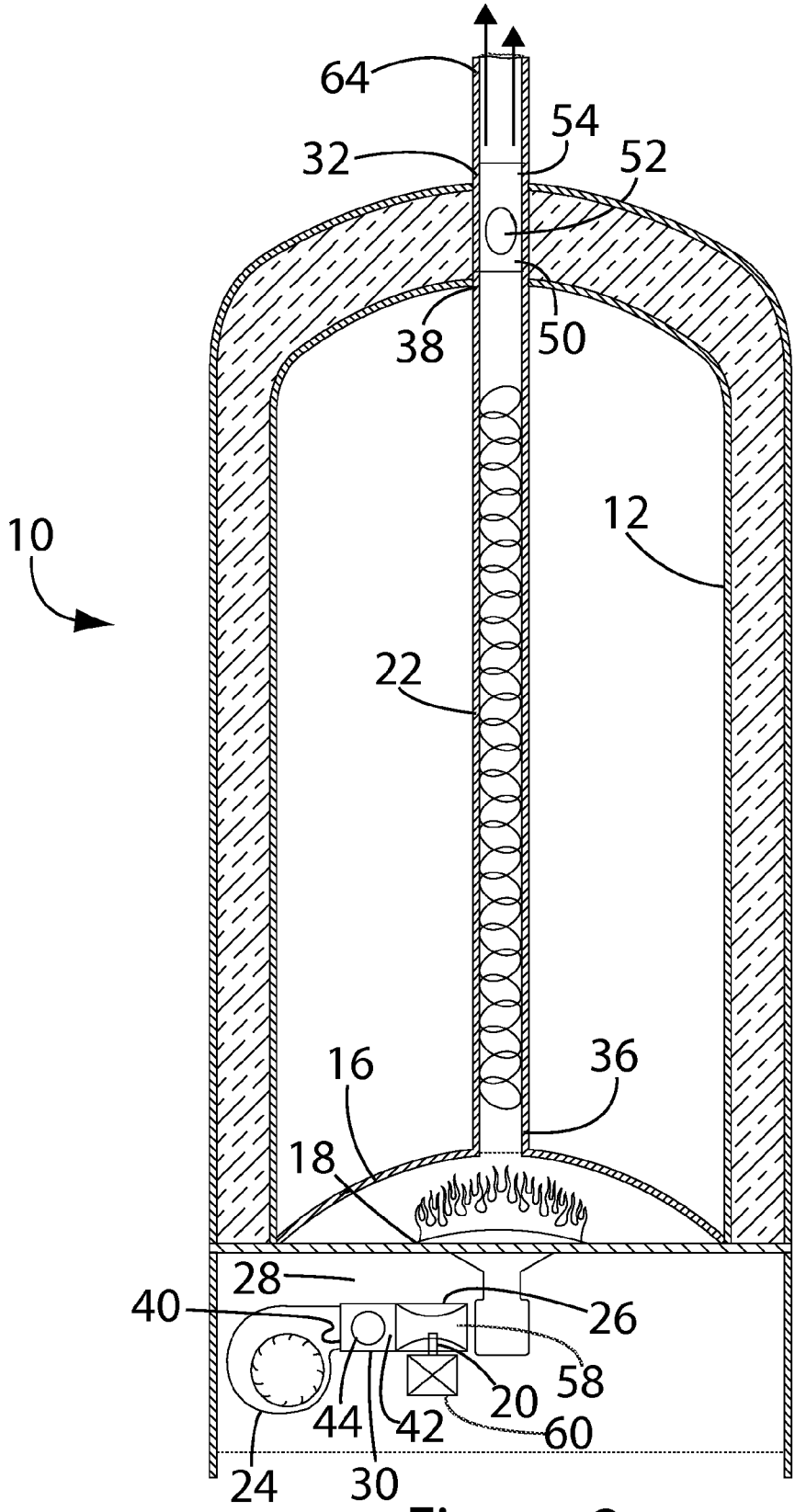
FIG. 2 is a schematic side sectional view of the water heater system of FIG. 1.

Reference numerals in the written specification and in the drawing figures indicate corresponding items.

DETAILED DESCRIPTION OF THE PREFERRED EMBODIMENT

A water heater system embodiment of the present invention is generally indicated by reference numeral 10 in Figures and 2. The water heater system 10 comprises a water tank 12, a jacket 14 surrounding the water tank, a burner plenum 16 adjacent the water tank, a pre-mix fuel burner 18 within the burner plenum, a fuel supply line 20, a flue 22, a blower 24 adapted and configured to blow air, a combustion air passageway 26, a dilution air passageway 28, an upstream manifold 30, and a downstream manifold 32.

The pre-mix fuel burner 18 is configured and adapted to combust fuel (e.g., natural gas, LP gas, etc.) to produce combustion products. The flue 22 has an upstream end 36 and a downstream end 38. The upstream end 38 of the flue 22 is in fluid communication with the burner plenum 16. The flue 22 is configured for passage of combustion products from the burner plenum 16 through the water tank 12 and toward the downstream end 38 of the flue 22 to heat water within the water tank. The upstream manifold 30 has an air intake passage 40, a combustion air discharge passage 42, and a dilution air discharge passage 44. The downstream manifold 32 has a combustion products intake passage 50, a dilution air intake passage 52 and an exit passage 54. The air intake passage 40 of the upstream manifold 30 is in fluid communication with and downstream of the blower 24. The upstream manifold 30 is adapted and configured such that some air entering the air intake passage 40 via the blower 24 is discharged out the combustion air discharge passage 42 and some air entering the air intake passage via the blower is discharged out the dilution air discharge passage 44. The fuel supply line 20 is adapted to supply fuel (e.g., natural gas, LP gas, etc.) into the combustion air passageway 26. The combustion air passageway 26 has an upstream end in fluid communication with and adjacent the combustion air discharge passage 42 of the upstream manifold 30. The combustion air passageway 26 facilitates fluid communication between the combustion air discharge passage 42 of the upstream manifold 30 and the fuel burner 18 such that air from the blower 24 via the combustion air discharge passage 42 and fuel from the fuel supply line 20 are fed to the pre-mix fuel burner 18 via the combustion air passageway 26 during operation of the water heater system 10. Preferably, the combustion air passageway 26 includes a venturi 58. The venturi 58 lowers the pressure of air passing through the combustion air passageway 26 in the vicinity of the venturi throat to facilitate introduction of fuel into the combustion air passageway via the fuel supply line 20. A fuel control valve 60 is in fluid communication with the fuel supply line 20. The fuel control valve 60 is adapted and configured to regulate fuel flow from a fuel supply (not shown) through the fuel supply line 20. the burner plenum 16 is adapted and configured to be at a pressure greater than ambient pressure during operation of the water heater system 10. The positive pressure in the burner plenum 16 facilitates upward movement of hot combustion products through the flue 22.

The combustion products intake passage 52 of the downstream manifold 32 is in fluid communication with the downstream end 38 of the flue 22 such that combustion products discharged from the flue during operation of the water heater system 10 enters the downstream manifold via the combustion products intake passage. The dilution air passageway 28 facilitates fluid communication between the dilution air discharge passage 44 of the upstream manifold 30 and the dilution air intake passage 52 of the downstream manifold 32. The water heater system 10 is adapted and configured such that air entering the downstream manifold 32 via the dilution air intake passage 52 and combustion products entering the downstream manifold via the combustion products intake passage 50 are discharged together via the exit passage 54 of the downstream manifold.

The water heater system 10 is configured such that during operation of the water heater system 10, the dilution air passing through the dilution air passageway 28 and into the downstream manifold is sufficient such that the mix discharged from the exit passage is at a temperature low enough to accommodate a PVC vent pipe 64. Preferably, the water heater system 10 is adapted and configured such that air flows through the combustion air passageway 26 at a flow rate of between about 33% and about 50% of the rate of air flowing through the dilution air passageway 28 during operation of the water heater. For example, the water heater system 10 may be configured such that about one third of the air entering the air intake passage 40 of the upstream manifold 30 via the blower 24 is discharged out the combustion air discharge passage 42 and about two-thirds of the air entering the air intake passage via the blower is discharged out the dilution air discharge passage 44.

The components of the water heater system 10 are configured and adapted such that the blower 24, the upstream manifold 30, the dilution air passageway 28 and the downstream manifold 32 are not readily visible when the water heater system is in service. Preferably, the entirety of the blower 24 and the upstream manifold 30 are under the water tank 12 and surrounded by the jacket 14. Also preferably the water tank 12 comprises a lower region 70 and an upper region 72. As shown in FIG. 1, a portion (e.g., a vertical run) of the dilution air passageway 28 extends downstream from between the jacket 14 and the lower region 70 to between the jacket and the upper region 72. Thermal insulation 74 is within the jacket 14 and surrounds the water tank 12. Preferably, the thermal insulation 74 also surrounds the vertical run of the dilution air passageway 28. The downstream manifold 32 is positioned above the water tank 12 and within the jacket 12. Thus, the blower 24, the upstream manifold 30, the dilution air passageway 28 and the downstream manifold 32 are not readily visible when the water heater system is in service.

In view of the foregoing, it will be seen that several advantages of the invention are achieved and attained.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A water heater system comprising:

a water tank;

a jacket surrounding the water tank;

a burner plenum adjacent the water tank;

a fuel burner within the burner plenum, the fuel burner being configured and adapted to combust fuel to produce combustion products;

a flue having an upstream end and a downstream end, the flue being at least partially within the water tank, the upstream end of the flue being in fluid communication with the burner plenum, the flue being configured for passage of combustion products from the burner plenum through the water tank and toward the downstream end of the flue;

a blower adapted and configured to blow air;

an upstream manifold having an air intake passage, a combustion air discharge passage, and a dilution air discharge passage, the air intake passage being in fluid communication with and downstream of the blower, the upstream manifold being adapted and configured such that some air entering the intake passage via the blower is discharged out the combustion air discharge passage and some air entering the intake passage via the blower is discharged out the dilution air discharge passage;

a combustion air passageway having an upstream end and a downstream end, the upstream end of the combustion air passageway being in fluid communication with the combustion air discharge passage of the upstream manifold, the combustion air passageway being adapted and configured to direct air discharged from the combustion air discharge passage of the air manifold to the burner;

a downstream manifold having a combustion products intake passage, a dilution air intake passage and an exit passage, the combustion products intake passage being in fluid communication with the downstream end of the flue such that combustion products discharged from the flue enters the downstream manifold via the combustion products intake passage;

a dilution air passageway in fluid communication with the dilution air discharge passage of the upstream manifold and in fluid communication with the dilution air intake passage of the downstream manifold, the dilution air passageway being adapted and configured such that dilution air exiting the dilution air discharge passage of the upstream manifold flows through the dilution air passageway and into the downstream manifold via the dilution air intake passage;

the water heater system being adapted and configured such that air entering the downstream manifold via the dilution air intake passage and combustion products entering the downstream manifold via the combustion products intake passage are discharged together via the exit passage of the downstream manifold.

2. A water heater system as set forth in claim 1 wherein the fuel burner comprises a pre-mix fuel burner.

3. A water heater system as set forth in claim 2 wherein the burner plenum is adapted and configured to be at a pressure greater than ambient pressure during operation of the water heater system.

4. A water heater system as set forth in claim 2 further comprising a fuel supply line adapted to supply fuel into the combustion air passageway.

5. A water heater system as set forth in claim 2 wherein the combustion air passageway includes a venturi, the water heater system further comprising a fuel supply line in fluid communication with the venturi, the fuel supply line being adapted to supply fuel to the venturi, the venturi being adapted and configured to facilitate introduction of fuel into the combustion air passageway.

6. A water heater system as set forth in claim 5 further comprising a fuel control valve, the fuel control valve being adapted and configured to regulate fuel flow from a fuel supply through the fuel supply line.

7. A water heater system as set forth in claim 1 wherein at least a portion of the dilution air passageway is between the jacket and the water tank.

8. A water heater system as set forth in claim 1 wherein the tank comprises a lower region and an upper region, and wherein a portion of the dilution air passageway extends downstream from between the jacket and the lower region to between the jacket and the upper region.

9. A water heater system as set forth in claim 8 further comprising thermal insulation surrounding the water heater and within the jacket, said portion of the dilution air passageway being adjacent some of the thermal insulation.

10. A water heater system as set forth in claim 8 wherein the downstream manifold is within the jacket.

11. A water heater system as set forth in claim 10 wherein the downstream manifold is above the tank.

12. A water heater system as set forth in claim 1 wherein the downstream manifold is above the tank.

13. A water heater system as set forth in claim 12 wherein the fuel burner comprises a pre-mix fuel burner.

14. A water heater system as set forth in claim 13 wherein the water heater system is adapted and configured such that air flows through the combustion air passageway at a flow rate of between about 33% and about 50% of the rate of air flowing through the dilution air passageway during operation of the water heater.

15. A water heater system comprising:

a water tank;

a jacket surrounding the water tank;

a burner plenum adjacent the water tank;

a pre-mix fuel burner within the burner plenum, the fuel burner being configured and adapted to combust fuel to produce combustion products;

a fuel supply line;

a flue having an upstream end and a downstream end, the upstream end of the flue being in fluid communication with the burner plenum, the flue being configured for passage of combustion products from the burner plenum through the water tank and toward the downstream end of the flue;

a blower adapted and configured to blow air;

a combustion air passageway;

a dilution air passageway;

an upstream manifold having an air intake passage, a combustion air discharge passage, and a dilution air discharge passage; and a downstream manifold having a combustion products intake passage, a dilution air intake passage and an exit passage;

the air intake passage of the upstream manifold being in fluid communication with and downstream of the blower, the upstream manifold being adapted and configured such that some air entering the intake passage via the blower is discharged out the combustion air discharge passage and some air entering the intake passage via the blower is discharged out the dilution air discharge passage, the fuel supply line being adapted to supply fuel into the combustion air passageway, the combustion air passageway facilitating fluid communication between the combustion air discharge passage of the upstream manifold and the fuel burner such that air from the blower via the combustion air discharge passage and fuel from the fuel supply line are fed to the pre-mix fuel burner via the combustion air passageway during operation of the water heater system, the combustion products intake passage of the downstream manifold being in fluid communication with the downstream end of the flue such that combustion products discharged from the flue during operation of the water heater system enters the downstream manifold via the combustion products intake passage, the dilution air passageway facilitating fluid communication between the dilution air discharge passage of the upstream manifold and the dilution air intake passage of the downstream manifold, the water heater system being adapted and configured such that air entering the downstream manifold via the dilution air intake passage and combustion products entering the downstream manifold via the combustion products intake passage are discharged together via the exit passage of the downstream manifold.

16. A water heater system as set forth in claim 15 wherein at least a portion of the blower is positioned under the tank.

17. A water heater system as set forth in claim 16 wherein at least a portion of the upstream manifold is positioned under the tank.

18. A water heater system as set forth in claim 17 wherein at least a portion of the downstream manifold is positioned above the tank.

19. A water heater system as set forth in claim 18 wherein the tank comprises a lower region and an upper region, and wherein a portion of the dilution air passageway extends downstream from between the jacket and the lower region to between the jacket and the upper region.

20. A water heater system as set forth in claim 19 further comprising thermal insulation surrounding the water heater and within the jacket, said portion of the dilution air passageway being adjacent some of the thermal insulation.

* * * * *